US011844384B1

(12) United States Patent
Price

(10) Patent No.: US 11,844,384 B1
(45) Date of Patent: Dec. 19, 2023

(54) WEDGE FOR USE WITH BATTING GLOVE OR BAT FOR IMPROVED BATTING PERFORMANCE

(71) Applicant: Larry J. Price, South Jordan, UT (US)

(72) Inventor: Larry J. Price, South Jordan, UT (US)

( * ) Notice: Subject to any disclaimer, the term of this patent is extended or adjusted under 35 U.S.C. 154(b) by 0 days.

(21) Appl. No.: 17/988,964

(22) Filed: Nov. 17, 2022

Related U.S. Application Data

(60) Provisional application No. 63/329,013, filed on Apr. 8, 2022, provisional application No. 63/280,905, filed on Nov. 18, 2021.

(51) Int. Cl.
*A41D 19/015* (2006.01)
*A63B 60/12* (2015.01)
*A63B 71/14* (2006.01)

(52) U.S. Cl.
CPC . *A41D 19/01588* (2013.01); *A41D 19/01547* (2013.01); *A63B 60/12* (2015.10); *A63B 71/143* (2013.01); *A63B 71/146* (2013.01); *A41D 2600/10* (2013.01)

(58) Field of Classification Search
CPC ..... A41D 19/01547; A63B 60/12; A63B 71/143; A63B 71/146
See application file for complete search history.

(56) References Cited

U.S. PATENT DOCUMENTS 1,690,312 A * 11/1928 Rosan ..... A63B 53/14 473/206
5,069,454 A * 12/1991 Frost ..... A63B 60/08 473/206
5,180,165 A * 1/1993 Frost ..... A63B 60/06 473/206
5,803,821 A * 9/1998 Lupinacci ..... A63B 71/146 2/161.3
5,806,091 A * 9/1998 McHugh ..... A41D 13/082 473/212
6,260,198 B1 * 7/2001 LoMedico ..... A41D 19/015 2/161.1
6,389,596 B2 5/2002 LoMedico
6,799,329 B2 10/2004 LoMedico
6,996,849 B2 2/2006 LoMedico
7,179,180 B1 * 2/2007 Frost ..... A63B 69/0002 473/206

(Continued)

FOREIGN PATENT DOCUMENTS

JP 4870310 B2 8/2012

*Primary Examiner* — Tajash D Patel
(74) *Attorney, Agent, or Firm* — WORKMAN NYDEGGER

(57) ABSTRACT

A "Power Wedge" can be inserted into a pocket of a batting glove, or used separately. The wedge can include an elongate generally teardrop shape, with an interior face that is convexly curved, defining a trough with a curvature that corresponds to the curvature of a bat handle. The wedge can include one or more tethering loops anchored inside the wedge. Such loops may extend from the wedge out the top end of the wedge. A tethering loop can also be provided extending out the bottom tapered end of the wedge, as well. Such loops may be wrapped around the thumb, index finger, and/or wrist of the user. Such tethers can also be wrapped around the bat handle. Such tethers are particularly helpful if the wedge is not received into pocket of a batting glove. The wedge can also be used with golf gloves and golf clubs.

21 Claims, 15 Drawing Sheets

(56) References Cited

U.S. PATENT DOCUMENTS

| | | | | |
|---|---|---|---|---|
| 7,484,248 | B2 | 2/2009 | LoMedico | |
| 8,763,162 | B2 | 7/2014 | LoMedico | |
| 8,852,033 | B1 * | 10/2014 | Frost | A63B 71/143 473/206 |
| 9,549,579 | B2 * | 1/2017 | Bailey | A41D 19/01564 |
| 9,603,394 | B2 | 3/2017 | LoMedico | |
| 10,136,685 | B2 * | 11/2018 | Beck | A41D 13/081 |
| 2021/0197066 | A1 * | 7/2021 | Williams | A63B 71/146 |

* cited by examiner

WEDGE FOR USE WITH BATTING GLOVE OR BAT FOR IMPROVED BATTING PERFORMANCE

CROSS-REFERENCE TO RELATED APPLICATIONS

Under 35 U.S.C. 119(e), the present application claims priority to and the benefit of U.S. Patent Application Ser. No. 63/280,905 filed Nov. 18, 2021, entitled BATTING GLOVE WITH WEDGE FOR INCREASED BATTING SPEED, as well as to U.S. Patent Application Ser. No. 63/329,013 filed Apr. 8, 2022, entitled BAT WITH ASSOCIATED WEDGE FOR INCREASED BATTING SPEED, each of which is herein incorporated by reference in its entirety.

BACKGROUND OF THE INVENTION

1. The Field of the Invention

The present invention generally relates to baseball batting gloves, baseball bats, golf gloves, and similar articles for improved batting or hitting performance.

2. The Relevant Technology

Baseball bats are of course used in playing the game of baseball. There is a recent trend among some baseball players to use a device, such as the PROHITTER that fits over the thumb of the batter, in order to enhance the batter's swing.

While such a device may provide for improved bat swing, there are problems that remain to be addressed.

BRIEF SUMMARY

In an embodiment, the present disclosure provides a baseball batting glove or a golf glove that includes a wedge ("power wedge") for use with a baseball bat or golf club. In an embodiment, the glove may include a glove body for receiving a user's hand or portion thereof (e.g., at least the palm portion of the hand), and a power wedge inserted into the glove body, so as to be positioned over the palm portion of the glove, between a thumb and index finger of the glove. In a right handed batting glove, the wedge is positioned over the right portion of the palm of the glove. In a left handed glove, the wedge is positioned over the left portion of the palm. The wedge is specifically provided with an elongated, generally teardrop shape. By teardrop shape, it is meant the shape shown in the attached Figures. The wedge may include a bat engaging surface which includes a concave curvature, so as to form an elongate trough that extends parallel with the longitudinal axis of the wedge. The radius of curvature of this portion may match the circular curvature of the handle of the bat, e.g., having a radius of curvature of about 0.5 inch (e.g., a typical bat may have a diameter of about 1 inch). The wedge is both narrower and thinner at its bottom end, and wider and thicker at its top end. The longitudinal axis may be considered an axis "x", while the width of the wedge may be considered to be defined along an axis "y", and the thickness of the wedge (corresponding to how far out the wedge extends radially from the bat handle when mated thereto) may be considered to be defined along an axis "z".

The wedge length along the x axis may be the longest of the wedge dimensions, defining the longitudinal length of the wedge. The wedge may have a length from 2-5 inches, for example, depending on size (e.g., S, M, L, XL, XXL). The width along axis y may be about 0.75 to about 1 inch at its maximum, which may be along the top half of the wedge. The bottom half of the wedge may taper along its bottom portion or bottom half, narrowing to about 0.5 inch at its bottom end. The thickness along axis z of the wedge may be thinnest adjacent the bottom end of the wedge (e.g., about 0.2 to 0.4 inch), tapering to be thicker in the mid-section and top portion of the wedge (e.g., about 0.75 to about 1.25 inch, including the curvature associated with the bat handle engaging face). Not including such curvature (e.g., measured from the bottom of the trough, to the full radial extension of the wedge thickness in the z dimension, such thickness may be about 25% less. For example, an exemplary wedge may have a thickness of about 0.75 inch through the mid-section and top portion, as measured from the bottom of the trough, and may have a thickness of about 1 inch, when measured from the top of the trough. Such shape and relative dimensions will be apparent from the Figures.

The tapered, thinner and narrower portion of the wedge (the wedge bottom) is oriented towards the central portion of the palm of the user during use, while the thicker, wider portion of the wedge (the wedge top) is oriented towards the peripheral edge of the palm of the user, specifically between the thumb and index finger, during use. When using two wedges (e.g., as shown in FIG. 9C), the second wedge may be inverted.

Such a wedge provides an effectively increased gripping diameter to the bat (or golf club) when used as described herein. Such increased gripping diameter allows the user to grip the bat more tightly, and with more power, enhancing hitting. Unlike the PROHITTER, the wedge can be secured within the batting glove (e.g., in a pouch or pocket thereof). The PROHITTER is prone to easily break, as it fits over the thumb of the batter. The present solution does not have such a drawback.

The glove may otherwise be like any other batting glove (or golf hitting glove), except that it may incorporate the wedge therein. In an embodiment, the wedge may be secured within a pouch or pocket, so as to be removable, allowing a user to insert a wedge of a particular desired size, as appropriate for the particular user. In another embodiment, the wedge could be fixed relative to the glove, integral therewith, so as to not be removable.

The glove may include any of a wide variety of straps or bands for securing the wedge into a pocket or pouch of the glove. Such a pocket or pouch may of course be provided within the palm portion of the glove, so as to accommodate the desired orientation and placement of the wedge, as described herein.

In an embodiment, one or more (e.g., one, two, or three) tether loops may be provided, permanently fixed, extending from said wedge. For example, one or more tether loops may extend from the top face of the wedge. In an embodiment, a tethering loop may additionally be provided extending from the bottom tapered edge of the wedge (e.g., from the location where the wedge is thinnest and narrowest in the y and z dimensions). Such tethers may allow the user to wrap such tethers around the index finger, thumb, and/or wrist of the user, as shown in the Figures.

In an embodiment, the wedge is formed from an elastomeric material, such as silicone, or the like. Such a material may have a moderate durometer value, such as similar to a pencil eraser or the like, so as to have some "give" when gripped within the palm of a user. By way of example, the wedge material may have a shore A durometer value of less than 80, less than 70, less than 60, or less than 50, such as 10 to 50, 20 to 50, 20 to 40, or 30 to 40.

The wedge is not simply the providing of padding within a batting or similar glove, as the placement (in the palm, between the index finger and thumb) and orientation (small tapered end towards the central portion of the palm, larger tapered end towards the peripheral edge of the palm, specifically the peripheral edge between the index finger and thumb) of the wedge is important. Padding within batting or hitting gloves is typically provided within an entirely different location, e.g., over the phalanges areas that often become calloused or bruised. The wedge is not provided for any padding purpose. In fact, the glove may not include such padding, in an embodiment. In another embodiment, conventional padding could be provided, in addition to the wedge.

As noted, a longitudinal axis of the wedge is oriented generally parallel to the thumb, when extending the thumb.

The glove body may include a pouch or pocket into which the wedge is received.

Such a wedge increases swing speed, power, or otherwise enhances the performance of the batter, as compared to use of a similar glove, without the wedge.

In an embodiment, the wedge can be selectively removed from the pouch or pocket in the glove body.

The glove may be provided with a plurality of differently sized wedges (e.g., S, M, L, XL, XXL), allowing a user to select an appropriately sized wedge for use.

In an embodiment, the glove may include a pull tab wrist band where the pull tab is routed through a ring (e.g., a D-ring), so that the pull tab extends through the ring, for pulling back in the opposite direction, for tightening the glove around the wrist of a user. Such a configuration is sometimes seen on ski gloves, but Applicant is not aware of such in batting gloves, or golf gloves. Such a configuration provides far greater tightening of the glove around the wrist of the user than the VELCRO wrist band straps that are typically seen with existing batting gloves, that do not include any such D-ring, where the ring allows the user to cinch the pull tab wrist band back over itself in the opposite direction during tightening, greatly enhancing the fit of the glove over the user's hand.

The present wedge can be used without incorporation of the wedge into a glove. For example, a power wedge can be used with a baseball bat where the wedge is configured for similar positioning between the thumb and index finger of the batter's hand, over the right portion of the palm for a right handed batter, or over the left portion of the palm for a left handed batter. The wedge includes the same tapered, generally teardrop shape described and shown herein. When the wedge is used without receipt of the wedge into a pouch or pocket of a glove, the wedge may advantageously include one or more tethering loops (e.g., elastomeric loops) as described, where such tethering loops are embedded (fixed) within the elongate teardrop shape of the wedge, for securing the wedge around a handle of a bat, or for insertion of a finger and/or thumb of the batter into said loops.

As described elsewhere herein, such a wedge may be formed from an elastomeric material.

The longitudinal axis of such a wedge may be oriented generally parallel to the thumb of the batting hand, when the thumb is extended.

Such a wedge increases swing speed, power, or otherwise enhances the performance of the batter, as compared to similar batting use, without the wedge.

In an embodiment, the wedge may be secured to the bat handle by VELCRO, compression tape, use of any provided elastomeric tethers, or other fastening mechanism.

Additional features and advantages of exemplary implementations of the invention will be set forth in the description which follows, and in part will be obvious from the description, or may be learned by the practice of such exemplary implementations. The features and advantages of such implementations may be realized and obtained by means of the instruments and combinations particularly pointed out in the appended claims. These and other features will become more fully apparent from the following description and appended claims or may be learned by the practice of such exemplary implementations as set forth hereinafter.

BRIEF DESCRIPTION OF THE DRAWINGS

In order to describe the manner in which the above-recited and other advantages and features can be obtained, a more particular description of the subject matter briefly described above will be rendered by reference to specific embodiments which are illustrated in the appended drawings. Understanding that these drawings depict only typical embodiments and are not therefore to be considered to be limiting in scope, embodiments will be described and explained with additional specificity and detail through the use of the accompanying drawings in which:

In FIG. 9A, the wedges are shown secured to the bat using compression tape or the like. In FIG. 9B, the wedges are shown attached to the bat handle using the tether loop extending out the thickened top end of each of the two respective wedges.

DETAILED DESCRIPTION

FIGS. 1A-1E illustrate an exemplary embodiment of the present wedge 100. As shown, the wedge 100 may be described as including a generally elongate teardrop shape, having a top portion 102, a bottom portion 104, as well as a concavely contoured surface 106, provided with a concave curvature that mates to a bat handle (e.g., a circular baseball bat handle). For a wedge provided for use with a golf club, the contoured surface 106 may have a concave curvature specifically shaped and sized to mate to a golf club handle, as shown in FIGS. 12A-12D.

Figure 1A:
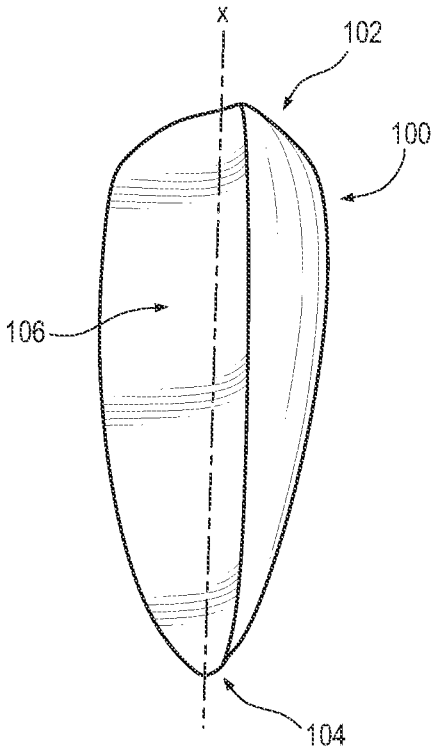
FIG. 1A illustrates an isometric view of the wedge according to the present invention, with the thicker top portion of the wedge oriented upwards.
Figure 1B:
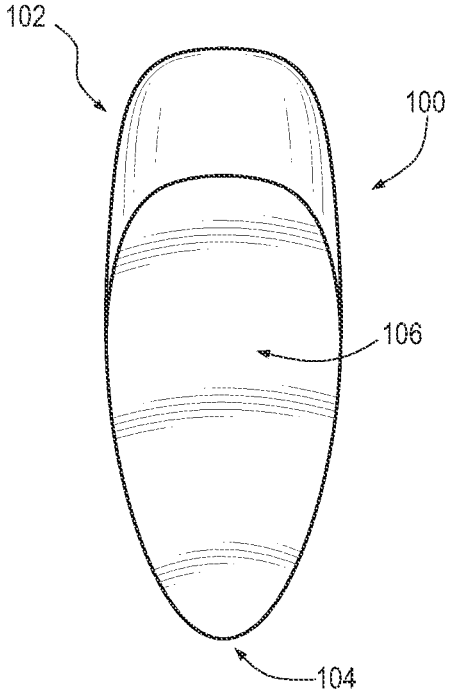
FIG. 1B illustrates a top rear view of the wedge of FIG. 1A according to the present invention, with the thicker top portion of the wedge oriented upwards.
Figure 1C:
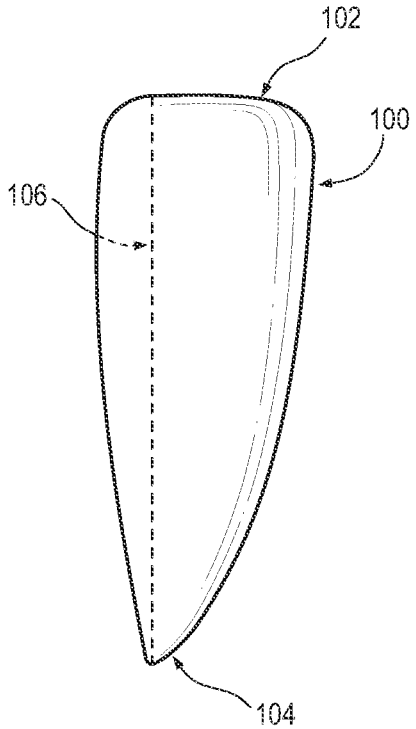
FIG. 1C illustrates a side view of the wedge of FIG. 1A according to the present invention, with the thicker top portion of the wedge oriented upwards.
Figure 1D:
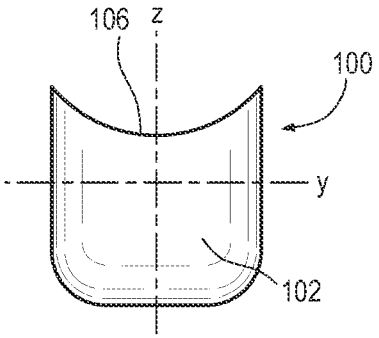
FIG. 1D illustrates a top view of the wedge of FIG. 1A according to the present invention.
Figure 1E:
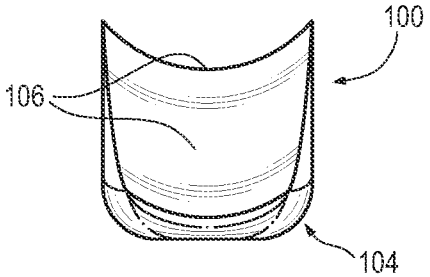
FIG. 1E illustrates a bottom view of the wedge of FIG. 1A according to the present invention, looking up the contoured concave channel that mates with the contour of the bat handle.
Figure 2A:
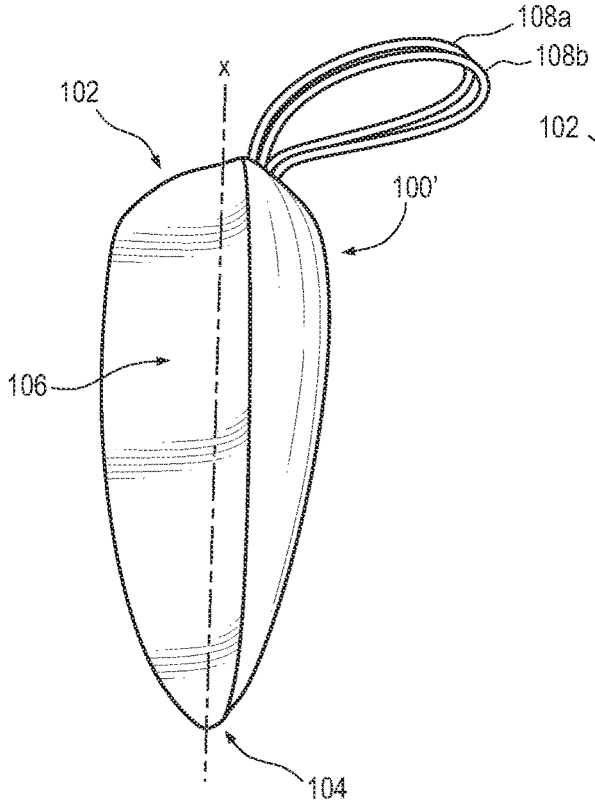
FIG. 2A illustrates an isometric view of another embodiment of the wedge according to the present invention, similar to FIG. 1A, but with a plurality of tether loops extending out the thicker top portion of the wedge.
Figure 2B:
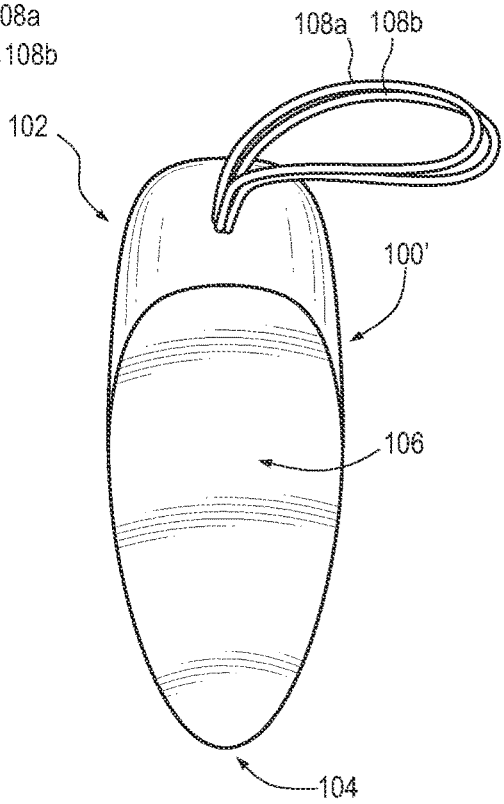
FIG. 2B illustrates a top rear view of the wedge of FIG. 2A.
Figure 2C:
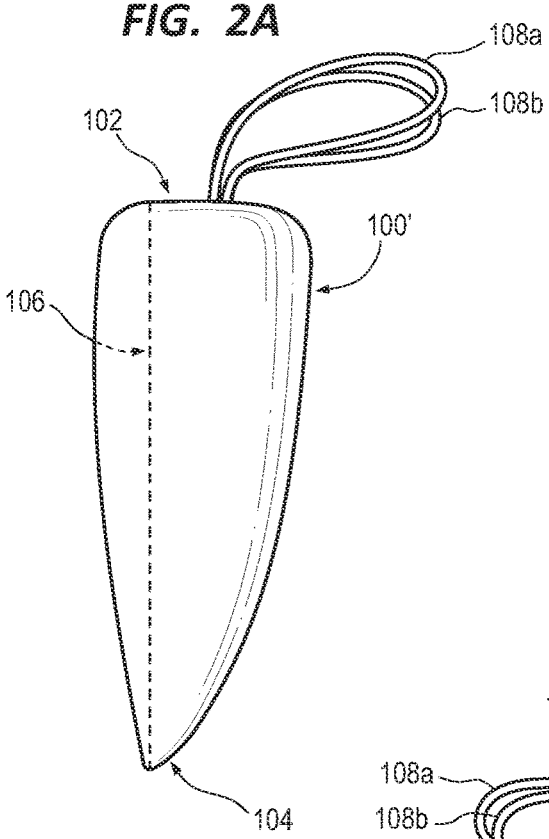
FIG. 2C illustrates a side view of the wedge of FIG. 2A.
Figure 2D:
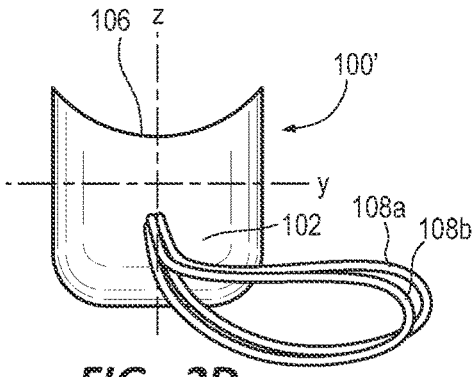
FIG. 2D illustrates a top view of the wedge of FIG. 2A.
Figure 2E:
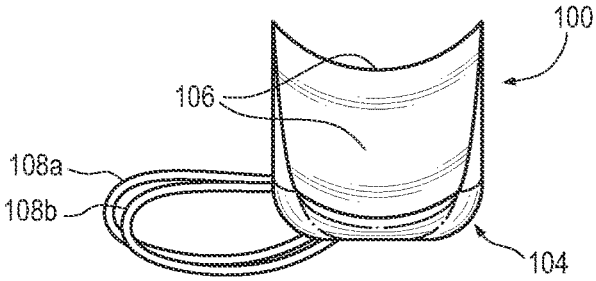
FIG. 2E illustrates a bottom view of the wedge of FIG. 2A.
Figure 3A:
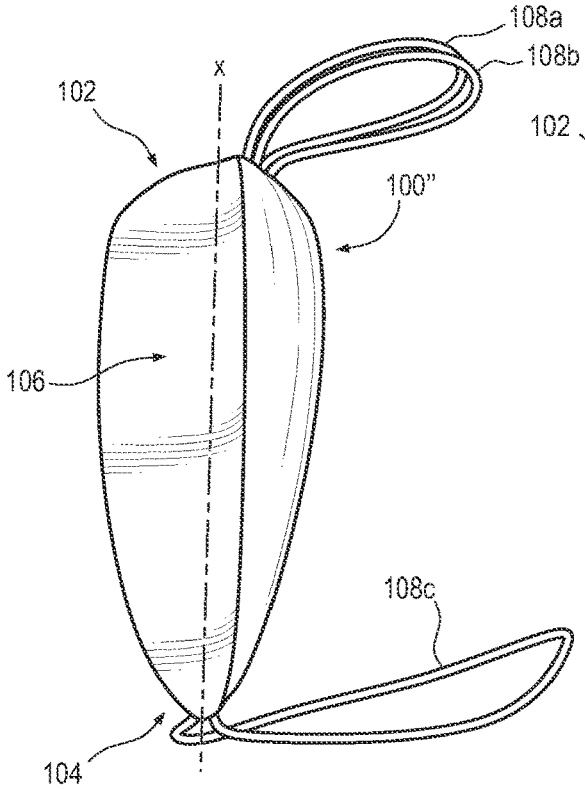
FIG. 3A illustrates an isometric view of another embodiment of the wedge according to the present invention, similar to FIG. 2A, but also including a tether loop extending out the thinner bottom end of the wedge.
Figure 3B:
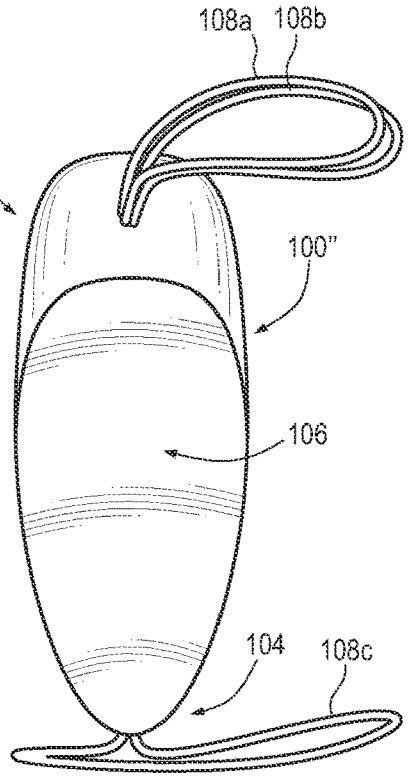
FIG. 3B illustrates a top rear view of the wedge of FIG. 3A.
Figure 3C:
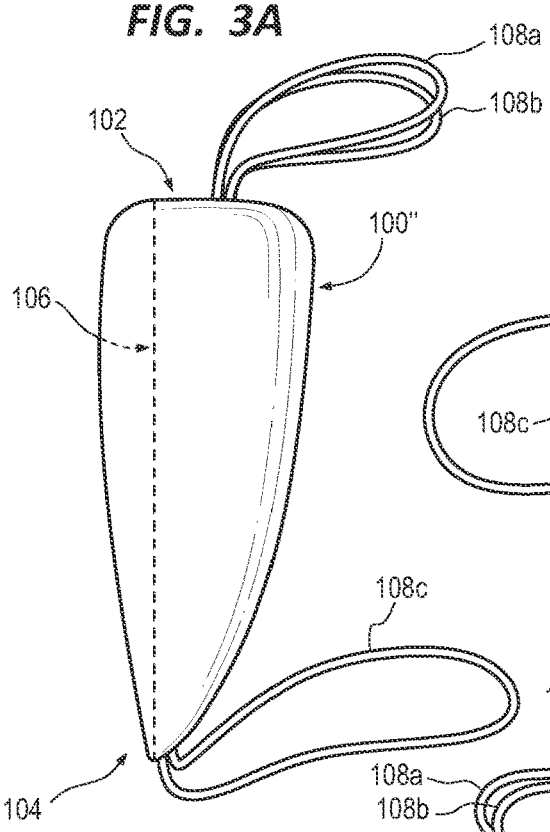
FIG. 3C illustrates a side view of the wedge of FIG. 3A.
Figure 3D:
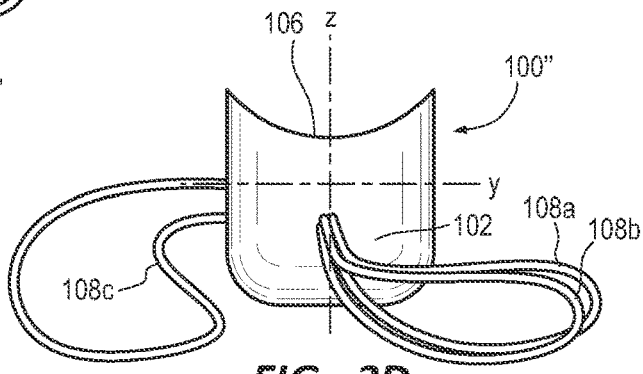
FIG. 3D illustrates a top view of the wedge of FIG. 3A.
Figure 3E:
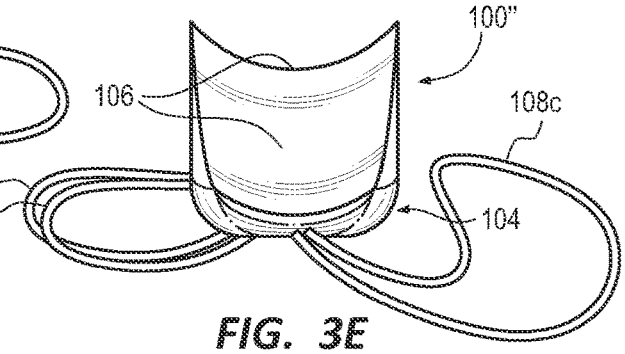
FIG. 3E illustrates a bottom view of the wedge of FIG. 3A.

The wedge 100 is both narrower and thinner at its bottom end or portion 104, and wider and thicker at its top end or portion 102. The longitudinal axis x transverse width axis y, and radial thickness axis z are shown in FIGS. 1A, and 1D, respectively. The radial thickness axis z is defined as extending radially outward from the bat, when the wedge is mated or positioned adjacent thereto, with the concave curved surface 106 mating into the curvature of the handle of the bat.

The wedge length, width and thickness throughout its various portions were described previously. Actual wedge dimensions may depend on the particular size (e.g., S, M, L, XL, XXL) of the given wedge. The distinct wedge shape is clearly shown in the Figures.

FIGS. 2A-2E show a similarly configured wedge 100', which similarly includes a top end or top portion 102, bottom end or bottom portion 104, and concavely curved interior surface 106, having a curvature that corresponds to the circular curvature of the exterior of the bat handle that the wedge is configured to be mated to. Wedge 100' further includes one or more (two are shown) elastomeric tether loops 108*a*, 108*b*. Such loops may extend out the top end or top portion 102 of wedge 100' as shown. In an embodiment, such loops may be molded into such wedge, fixed thereto (rather than being removable). Such loops 108*a*, 108*b* may be provided for securing around an index finger and/or thumb of a user, particularly when the wedge is not received into a pouch or pocket of an associated batting glove or golf glove. In contrast, the wedge 100 shown in FIGS. 1A-1E, without such loops may be particularly configured for insertion into a pouch or pocket of a batting glove or golf glove.

FIGS. 3A-3E illustrate another similarly configured wedge 100", which also includes loops 108*a*, 108*b*, but also includes an additional tethering loop 108*c*, extending from the bottom end 104 of the wedge 100" as shown. In an embodiment, the loops 108*a*, 108*b* extending out the top end 102 are shorter than loop 108*c* extending out the bottom end 104, as loops 108*a* and 108*b* are configured to wrapping around the index finger and thumb (which are about equal distance away, such that such loops may be substantially equally sized), while longer loop 108*c* is configured for wrapping around the wrist of the user, which is significantly further away, so that a longer loop is needed. While any of various lengths for the loops may be possible, in an embodiment, the top loops 108*a*, 108*b* may be about 1 to 3 inches in length, while the bottom loop may be significantly longer, e.g., about 4 to 8 inches in length. All such loops may be formed from a simple elastomeric cord, or the like.

Figure 4A:
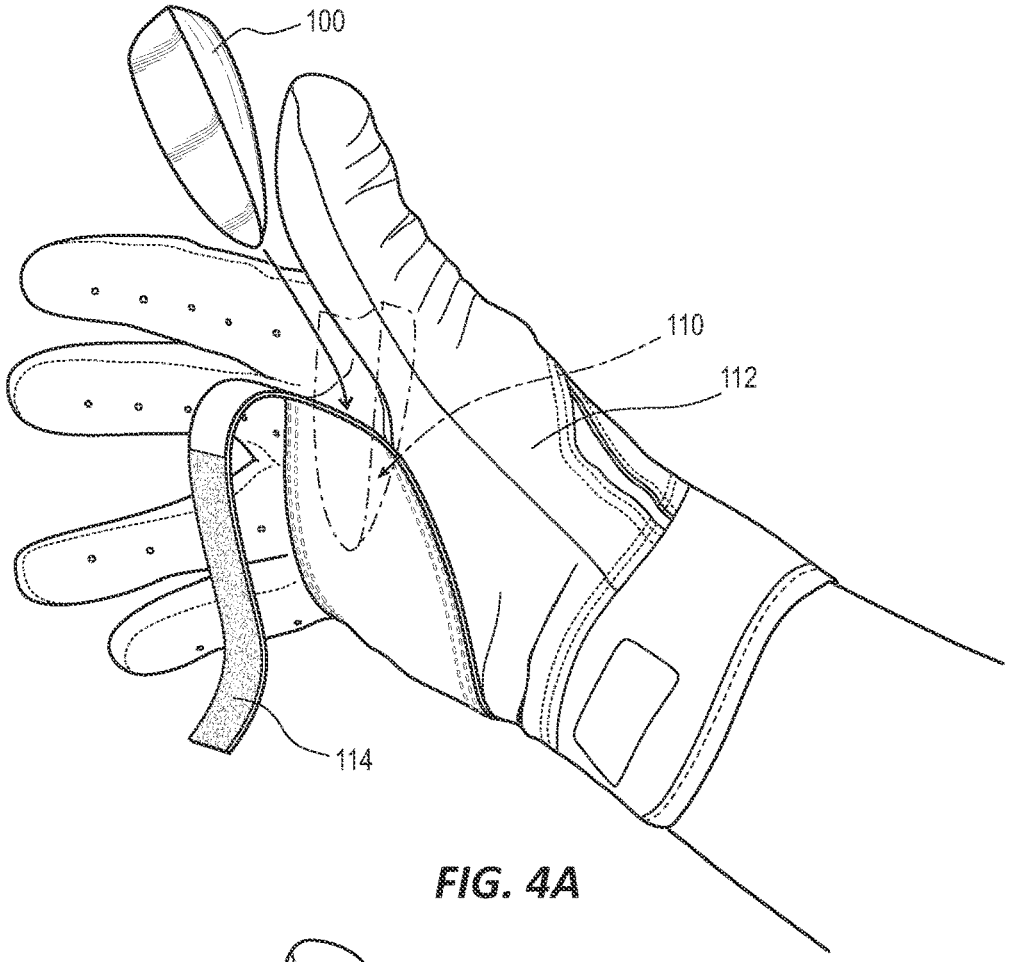
FIG. 4A shows an exemplary baseball batting glove including an internal pouch or pocket for receiving the wedge of FIGS. 1A-1E, and an attachment pull tab for securing the wedge within the palm portion of the glove, within the pouch or pocket while batting.
Figure 4B:
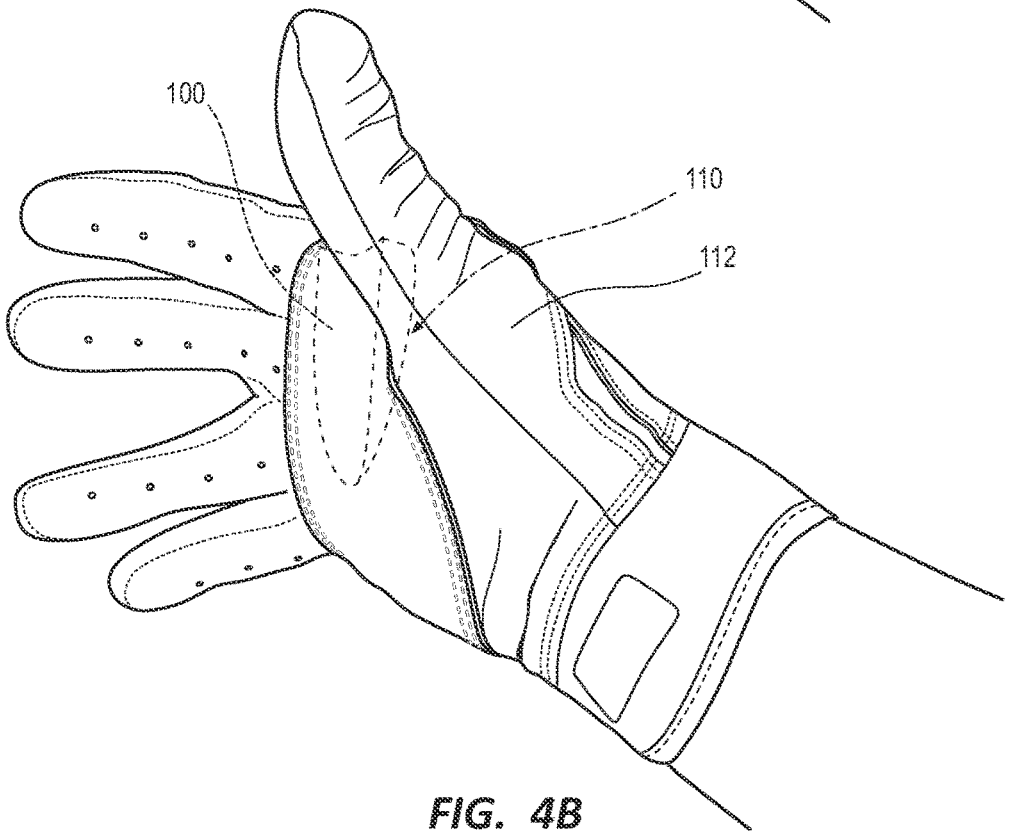
FIG. 4B shows the glove of FIG. 4A, with the wedge inserted into the pouch, and the pull tab secured over the pouch or pocket, holding the wedge in place.

FIGS. 4A-4B illustrate how the wedge 100 may be inserted into a pocket 110 of a glove body 112. As shown, such a pocket or pouch 110 is provided within the palm portion of the glove body 112, and the wedge is inserted therein so as to be positioned over the palm portion of the glove, with the concavely curved surface 106 oriented outwards (although still within the pocket or pouch 110), for engagement and mating with the correspondingly circular curvature of the baseball bat. As shown in FIG. 4A, in an embodiment, a strap 114 may be provided, for pulling over the opening of the pouch or pocket 110, securing the wedge 100 therein, once the strap 114 is pulled over the palm portion, over the other (backhand) side of the glove, between the thumb and index finger. FIG. 4B shows the wedge thus secured in place, hidden within the pouch 110.

Figure 4C:
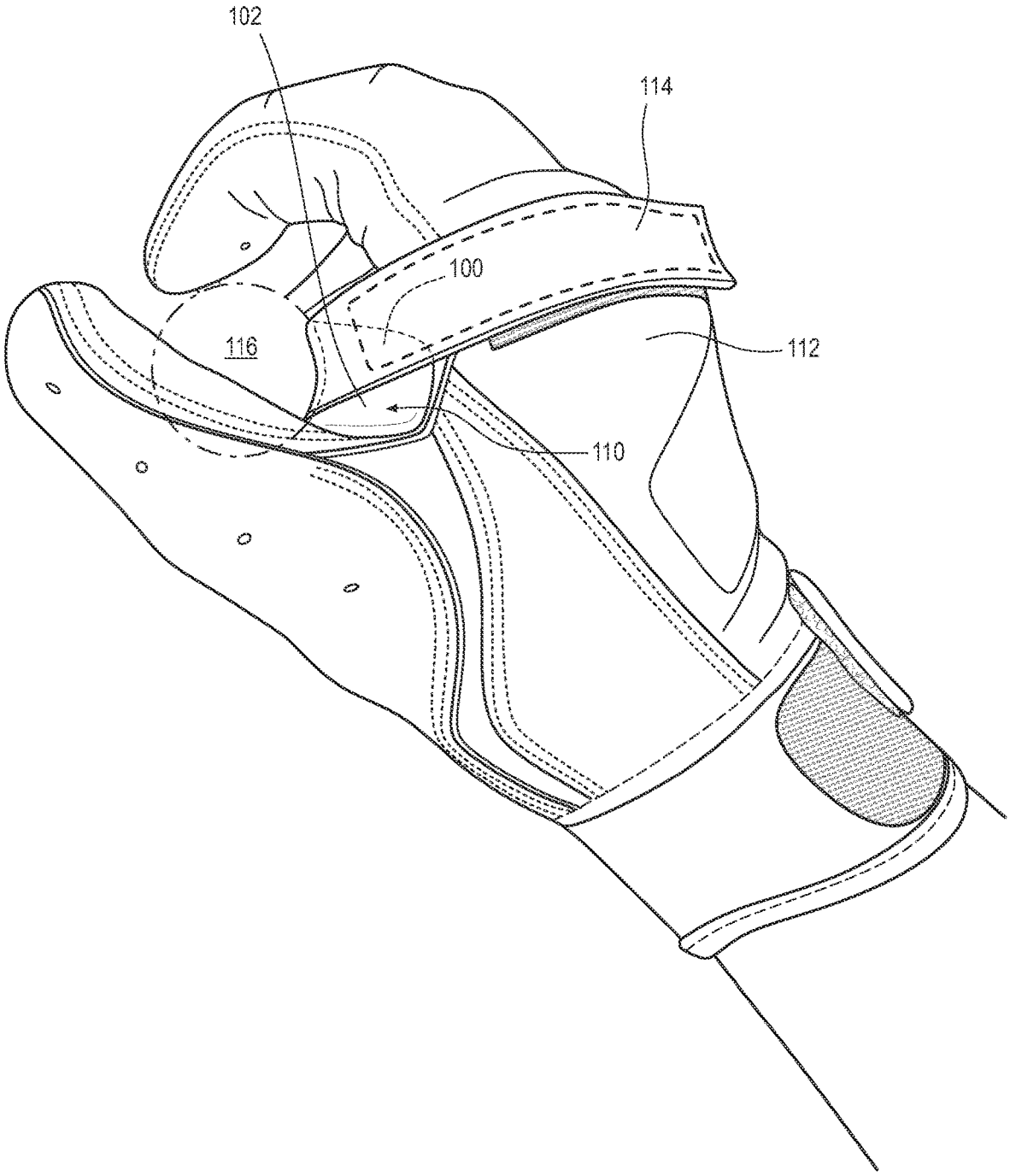
FIG. 4C shows how the glove of FIG. 4B positions the concavely curved elongate surface of the wedge to mate with the correspondingly curved circular cross section of the bat, while batting.
Figure 5:
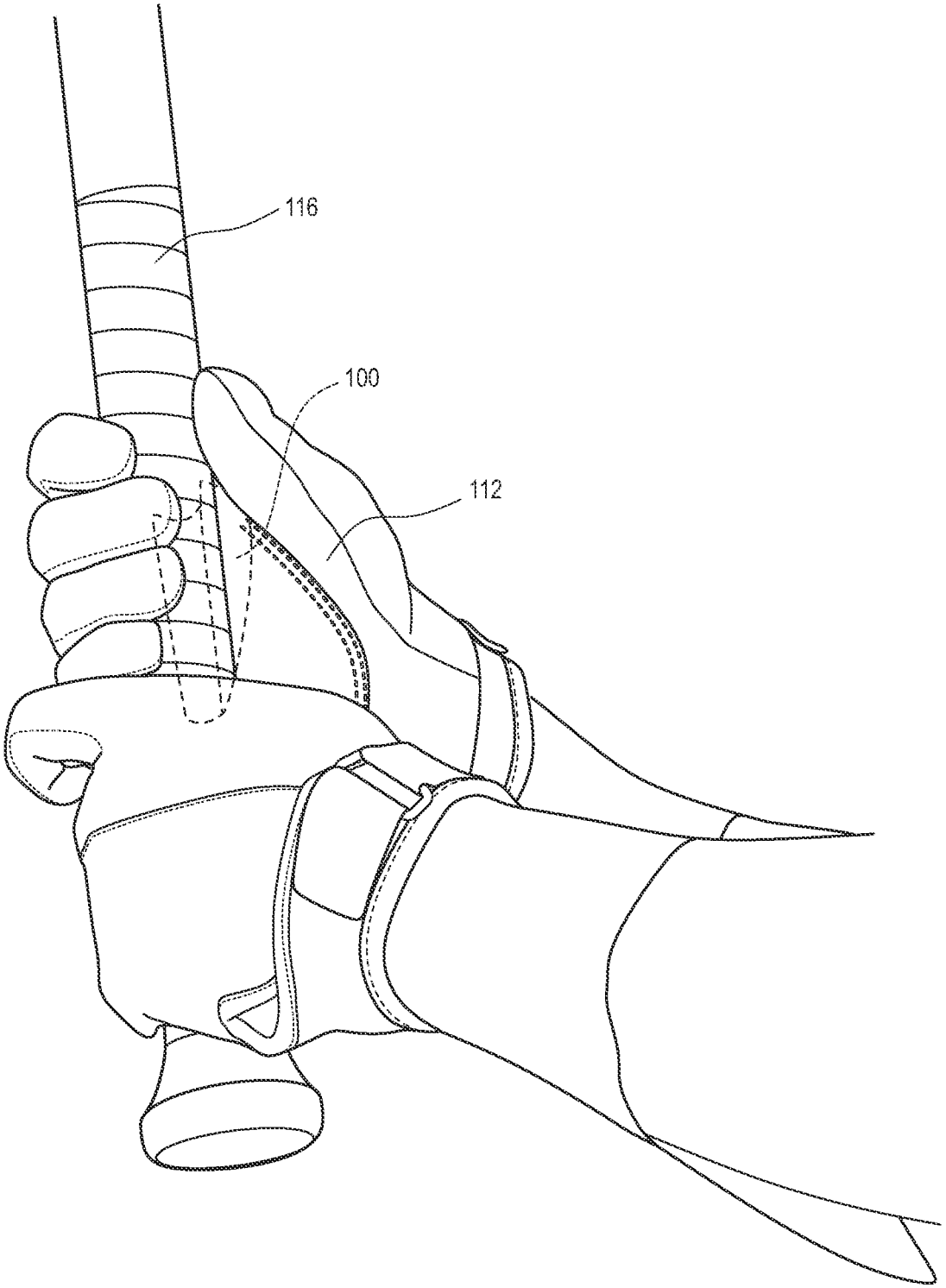
FIG. 5 shows the glove of FIG. 4C from another perspective, showing how the wedge within the pouch of the batting glove mates with the curvature of the bat, providing an effectively increased diameter or thickness to the bat, when gripping the bat with the batting glove having such a wedge.

FIG. 5 shows such a glove (the right hand glove), used with a conventional left hand batting glove (without any wedge or pocket), gripping a baseball bat 116. The wedge 100 within the pouch 110 of glove body 112 is oriented during such gripping of the bat, so that the convexly curved contoured trough 106 engages into the circular curvature of the handle of bat 116. FIG. 4C shows a view that perhaps most clearly illustrates this orientation and relationship between the convexly curved surface/trough 106 and the handle of bat 116.

Figure 6:
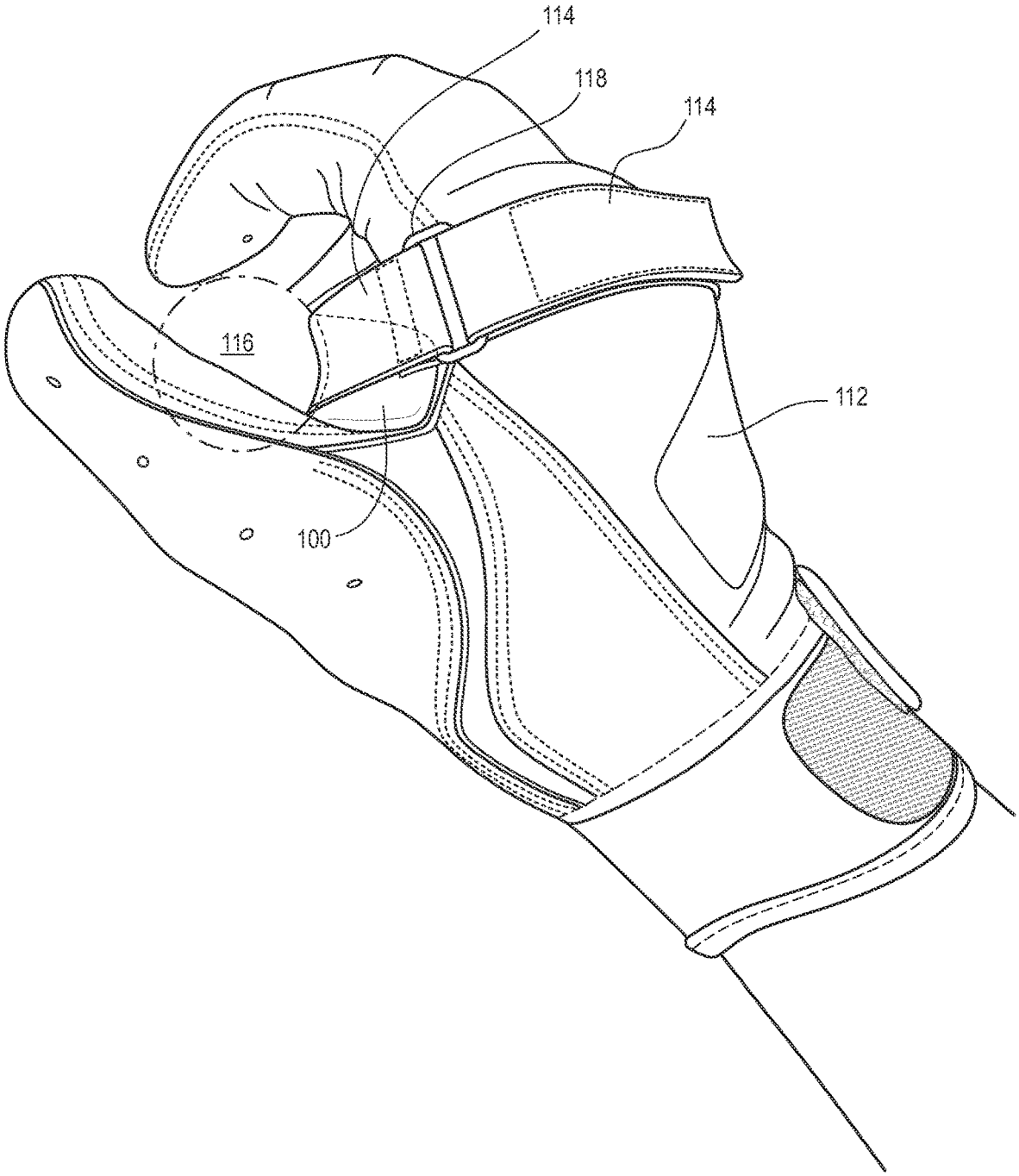
FIG. 6 shows a glove similar to that of FIG. 4C, but in which the pull tab for securing the wedge in the pouch or pocket includes a ring, for more securely cinching or tightening the wedge within the pouch of the glove.

FIG. 6 shows a view similar to that of FIG. 4C, but in which the strap 114 is somewhat differently configured. For example, in the embodiment shown in FIG. 4C, strap 114 may be a simple VELCRO (hook and loop fastener) strap that is pulled over from the palm side of the glove, over the pouch or pocket 110, for securement to the backhand side of the glove body 112. In FIG. 6, an intermediate ring (e.g., D-ring) 118 is provided in conjunction with such strap 114, allowing the strap 114 to be threaded or routed through such ring 118, to provide tighter cinching of the strap, as it is closed over pouch or pocket 110.

Figure 7:
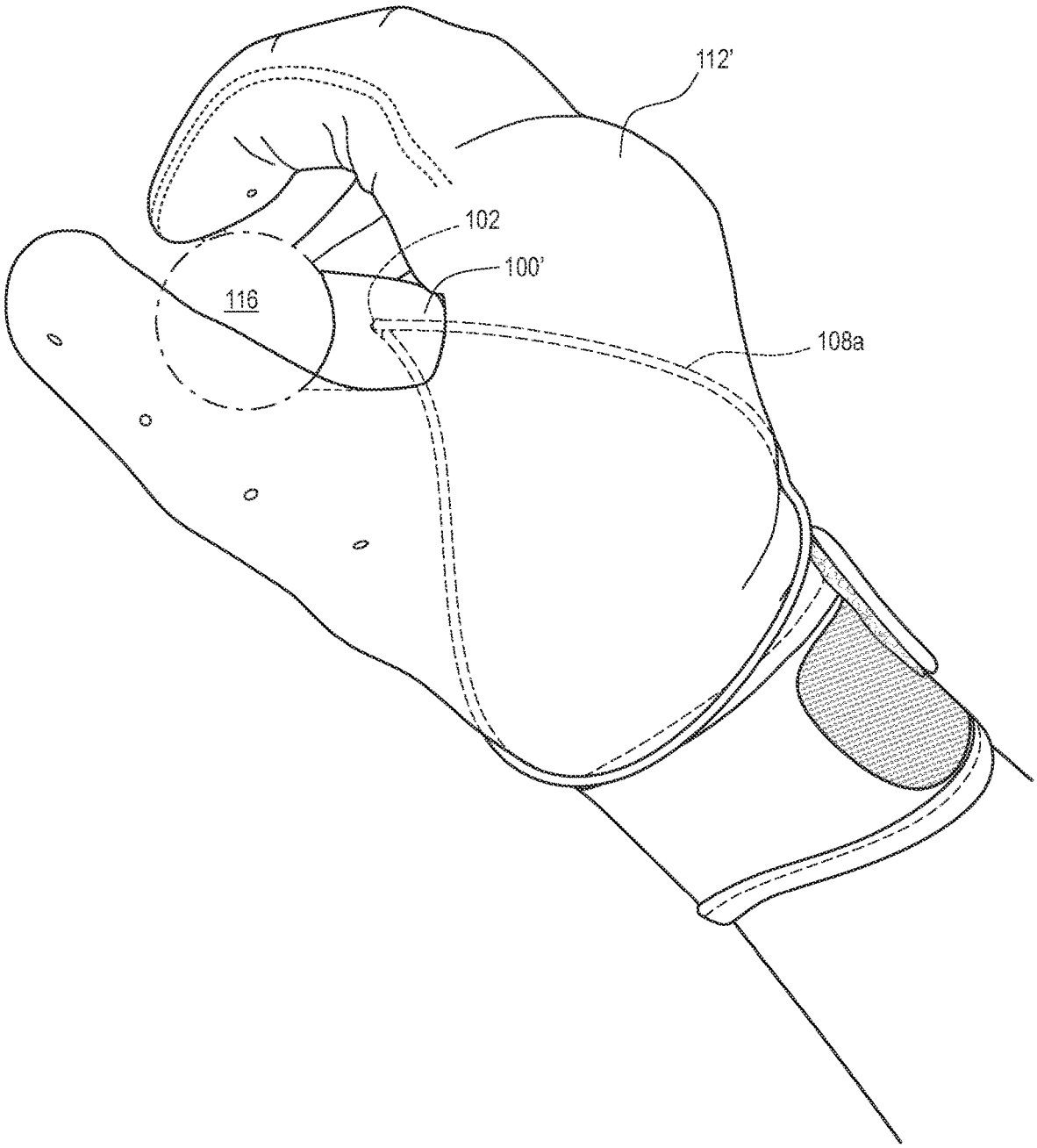
FIG. 7 shows use of a wedge such as that shown in FIGS. 2A-2E, where the tether extending out the thickened top end of the wedge is secured around the wrist of the batter. As shown, such a wedge may be used outside of the batting glove (no pouch or pocket is required).

FIG. 7 shows a configuration similar to wedge 100', with a tethering loop 108*a* extending out the top 102 of wedge 100'. Such loop 108*a* is shown as being long enough to wrap around the wrist of the user. It will be noted that the wedge 100' shown in FIG. 7 is simply gripped in the gloved hand of the user, without insertion into any pouch (glove body 112' may not include any such pouch or pocket). The wedge may be secured to the batters right hand by tether 108*a*, wrapped over the wrist as shown. Where two tethers 108*a* and 108*b* are provided extending from the top end 102, they may be shorter tether loops, and wrapped around the index finger and thumb of the user, as clearly shown in FIG. 10A. While FIG. 10A also shows a tether loop 108*c* extending out the bottom 104 of the wedge, such is not necessarily provided.

Figure 8A:
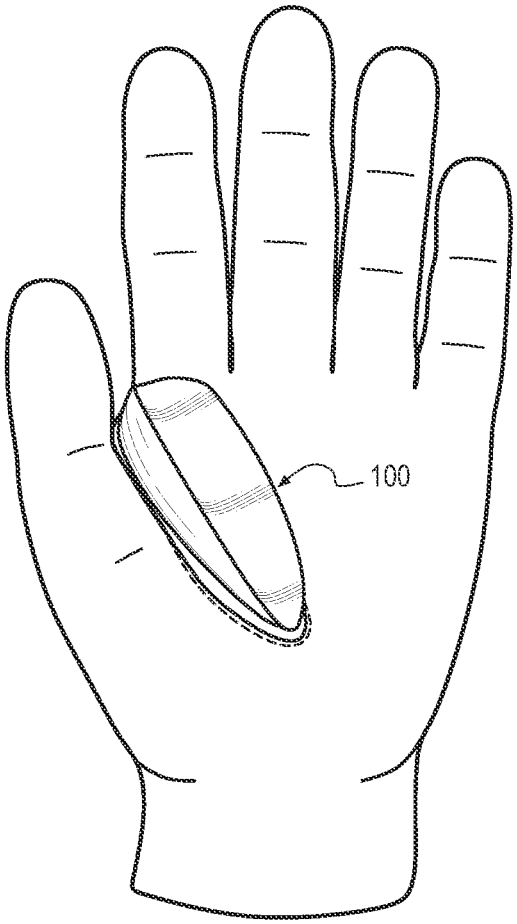
FIG. 8A-8B show how the wedge may be provided in a variety of sizes, e.g., such as Small, Medium, Large, XLarge, and XXLarge. The wedge shown in FIG. 8A is smaller than that of FIG. 8B, but both are otherwise of generally the same shape.
Figure 8B:
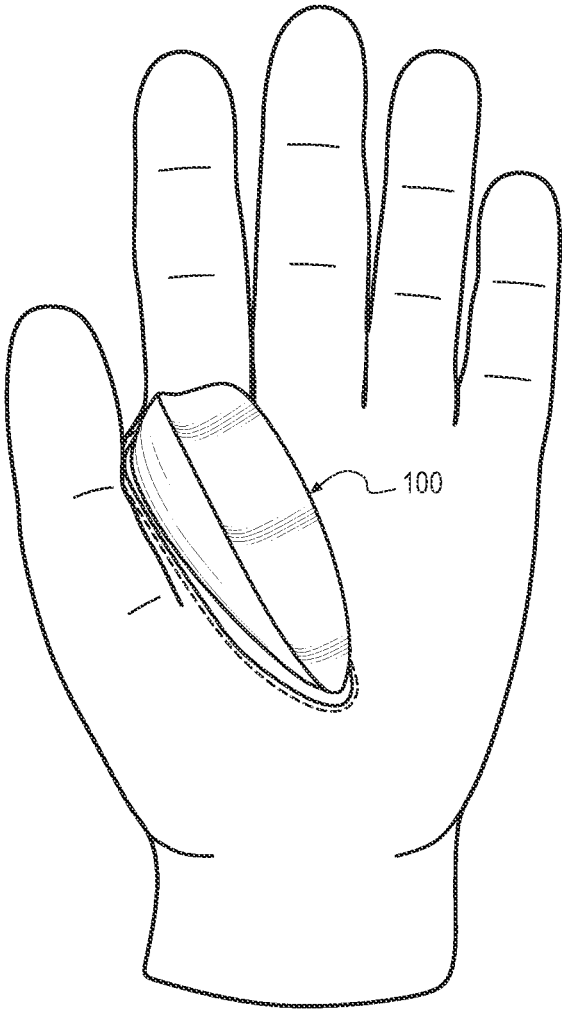

FIGS. 8A-8B simply show how the wedge 100 can be provided in different sizes, depending on the size of the hand of the user. For example, FIG. 8A shows a Small size wedge 100, while FIG. 8B shows a Large size wedge.

Figure 9A:
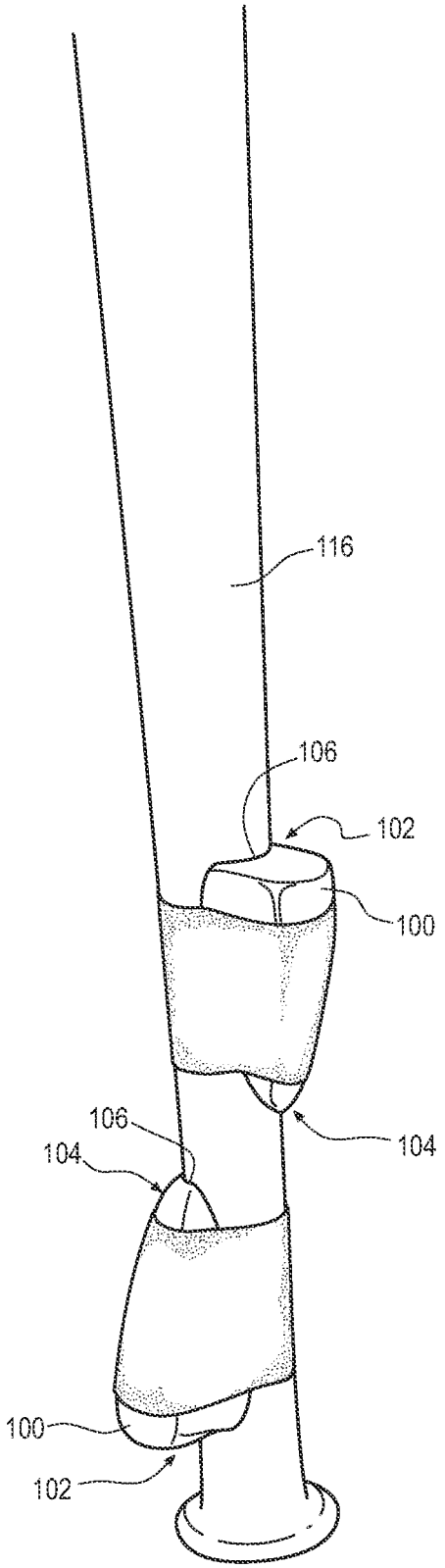
FIGS. 9A-9B illustrate how two batting wedges can be used, one for each of the batter's hands, with a baseball bat.
Figure 9B:
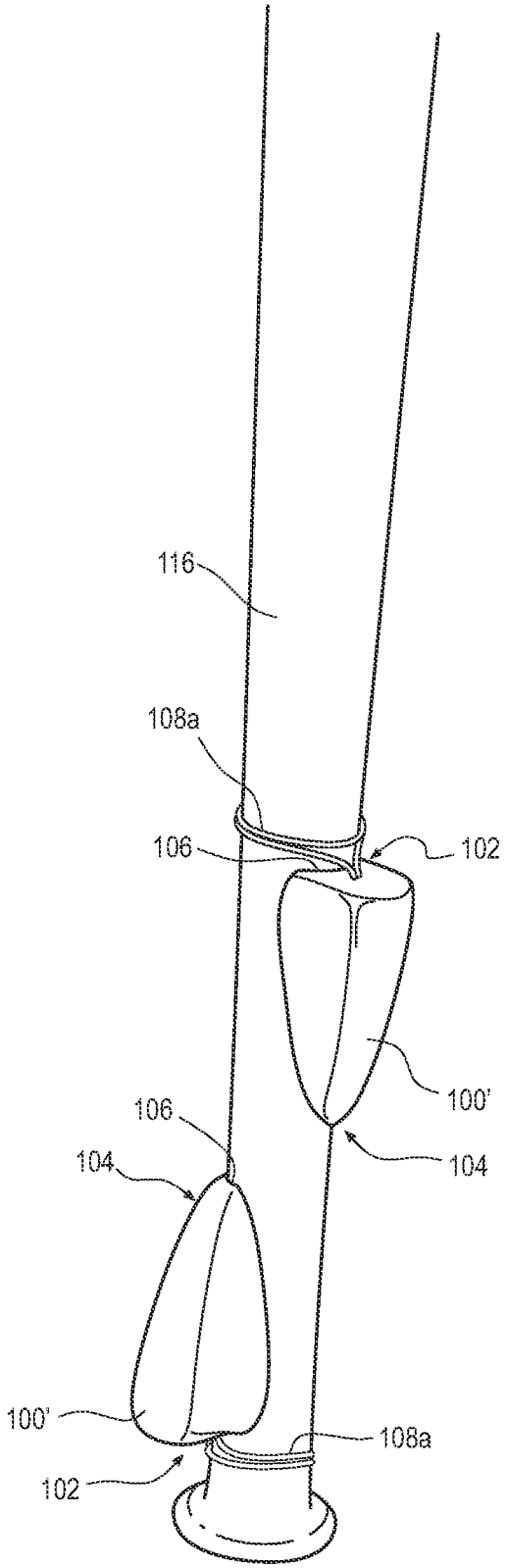

FIG. 9A illustrates attachment of two wedges 100 to a baseball bat 116, e.g., using VELCRO, compression tape or any other suitable fastener. FIG. 9B shows two wedges 100' similarly attached to the bat 116, but using tether loops 108*a*, extending out the top end 102 of each wedge 100'. As shown in FIGS. 9A-9B, for a right handed batter, the right hand wedge may be oriented as described previously, with the top end 102 oriented up, so that top end 102 will be positioned over the peripheral edge of the palm area of the gloved hand of the user, between the index finger and the thumb. The lower, left hand wedge is inverted, so that the bottom narrow tapered end of the wedge is oriented in this same general location (over the peripheral edge of the palm, between the index finger and thumb).

Figure 9C:
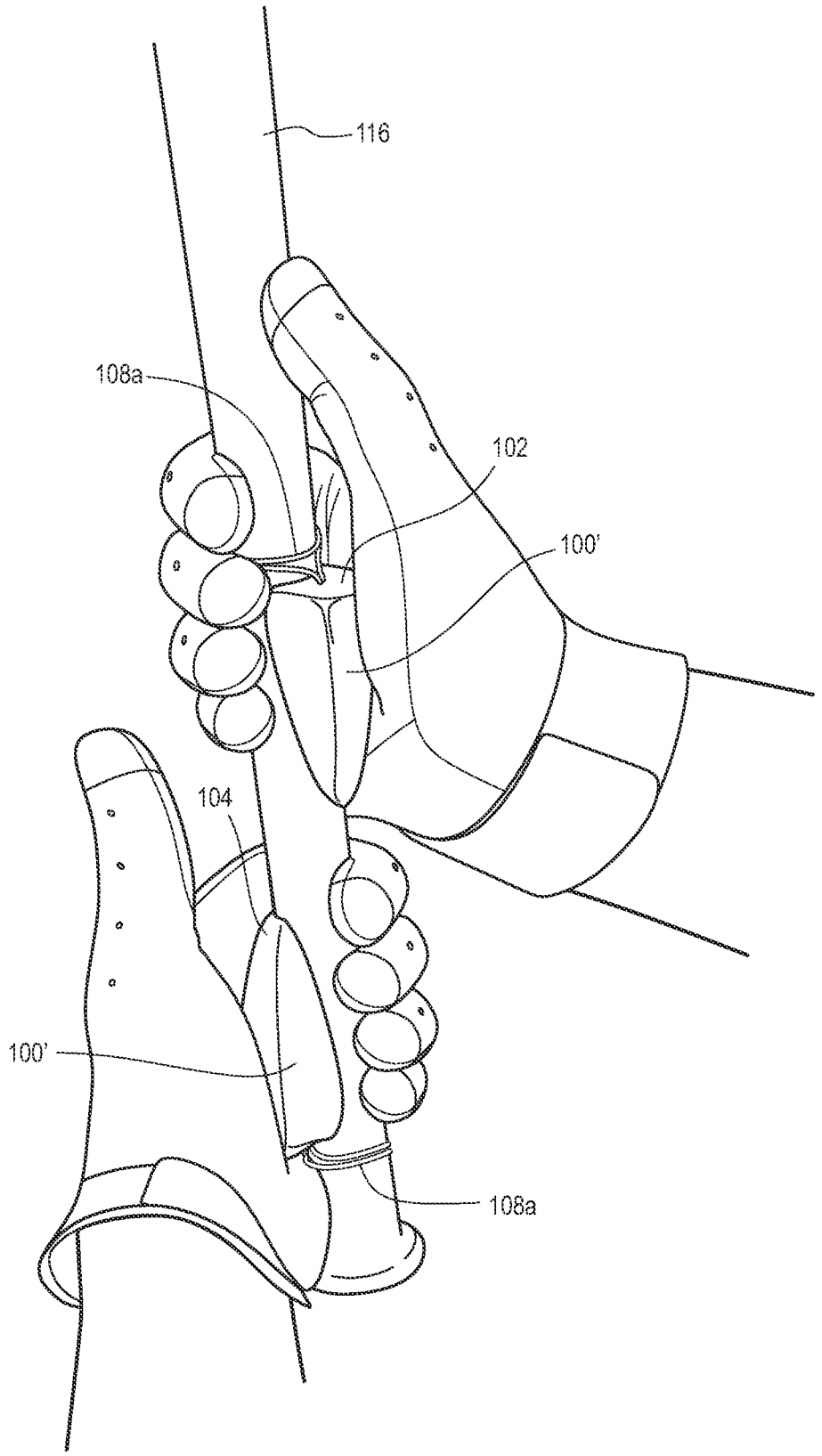
FIG. 9C shows the configuration of FIG. 9B, gripped by a batter, with the two gloved hands of the batter gripping the bat over the wedges attached to the bat, with the wedges positioned within the palm of the hand of each respective hand, where the longitudinal axis of each wedge is generally positioned parallel and aligned with the extended thumb of each hand. It is noted that the lower of the two wedges is inverted relative to the upper wedge, so that the thickened end portions of each wedge are oriented away from one another.

FIG. 9C illustrates the same configuration as shown in FIG. 9B, but where the users right and left gloved hands (with no pockets or pouches in such gloves) are gripped over the bat and the wedges 100' in the manner described.

Figure 10A:
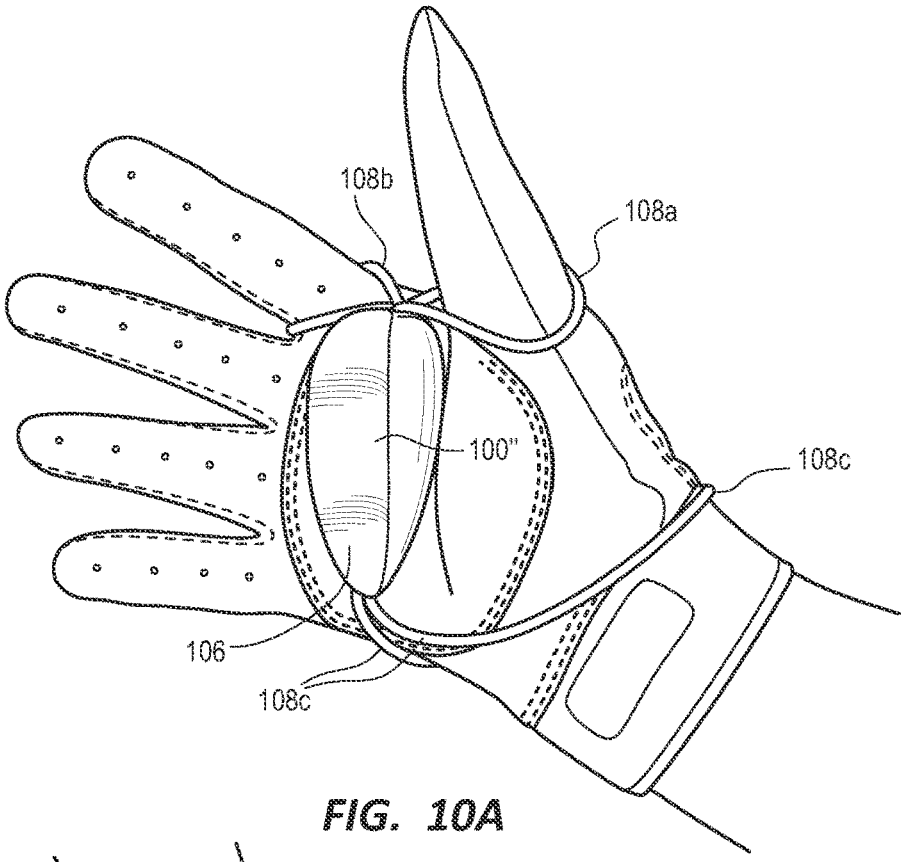
FIGS. 10A-10B show use of a wedge such as that shown in FIGS. 3A-3E, where the two tethers extending out the thickened top end of the wedge are secured one around the index finger, and the other around the thumb of the gloved hand of the batter. The tether extending out the thinned bottom end of the wedge is significantly longer in length than the top end tethers, and is wrapped around the wrist of the gloved batters hand.
Figure 10B:
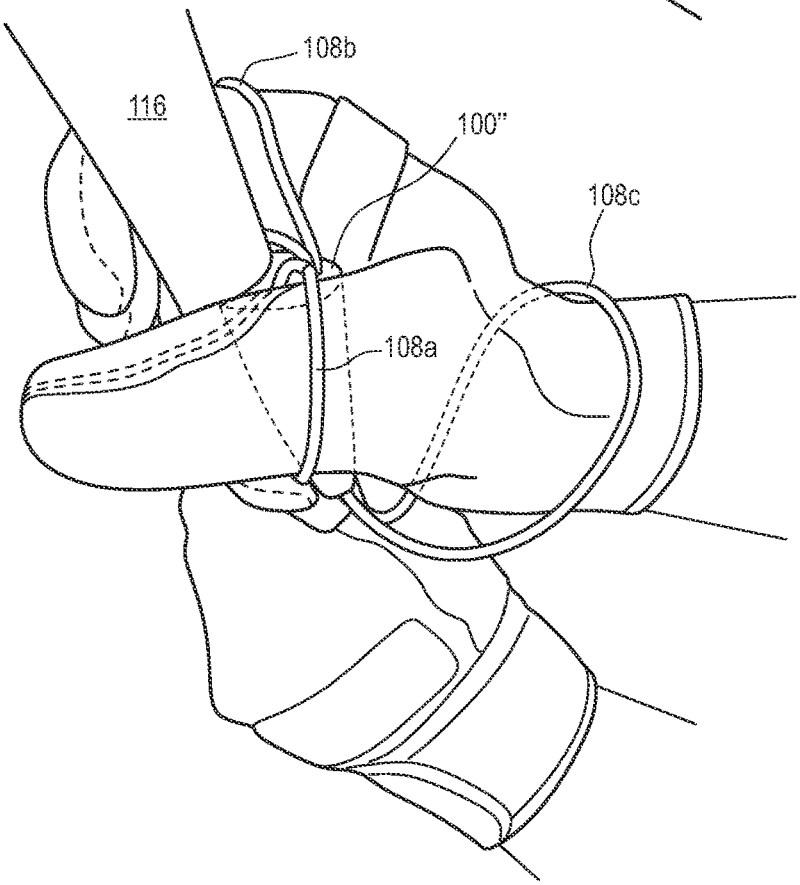

FIGS. 10A-10B show use of the wedge 100" within the gloved hand of the user (FIG. 10A) and while gripping the bat 116 (FIG. 10B). As shown, elastomeric tether loop 108*a* is wrapped around the thumb, loop 108*b* is wrapped around the index finger, and loop 108*c* is wrapped around the wrist. Because of the presence of the tethering loops, the glove is not required to include any pouch or pocket for receipt of the wedge 100".

Figure 11:
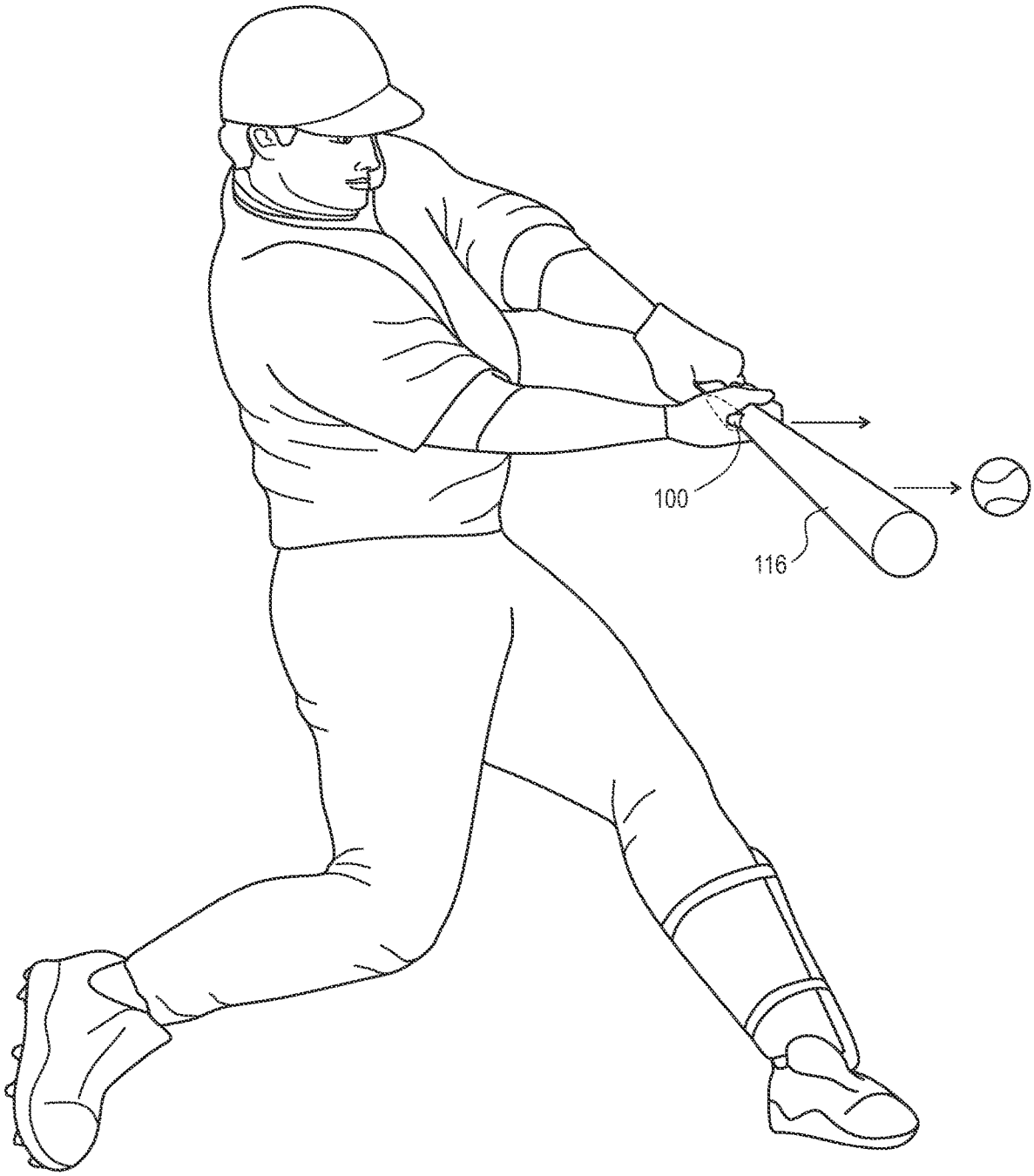
FIG. 11 shows a batter using the wedge, e.g., within a pocket of the right glove, to improve batting performance.

FIG. 11 shows use of any of the wedges (e.g., 100, 100', or 100" while hitting with the bat 116. As shown, when contacting the ball, the wedge may be oriented in substantially the same plane as defined by the bat and the approaching (or recently contacted) ball (i.e., a straight line connection between the ball, the bat, and the wedge on the back side of the bat). In other words, the wedge is lowered so as to be substantially "square" when impacting the ball with the bat. The batter's hands/wrists may roll immediately after connection of the ball with the bat. Of course, other batting techniques could also be used.

Figure 12A:
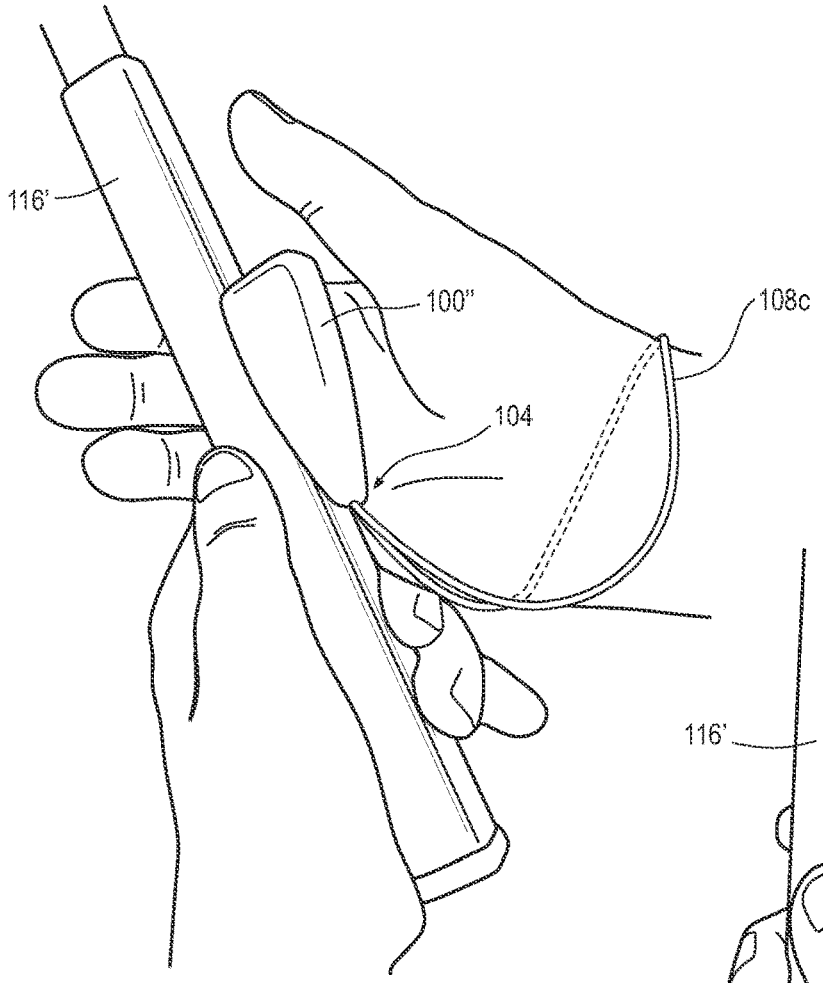
FIGS. 12A-12C illustrate how the wedge may also be used with a golf putter, or other golf club to provide similar benefits.
Figure 12B:
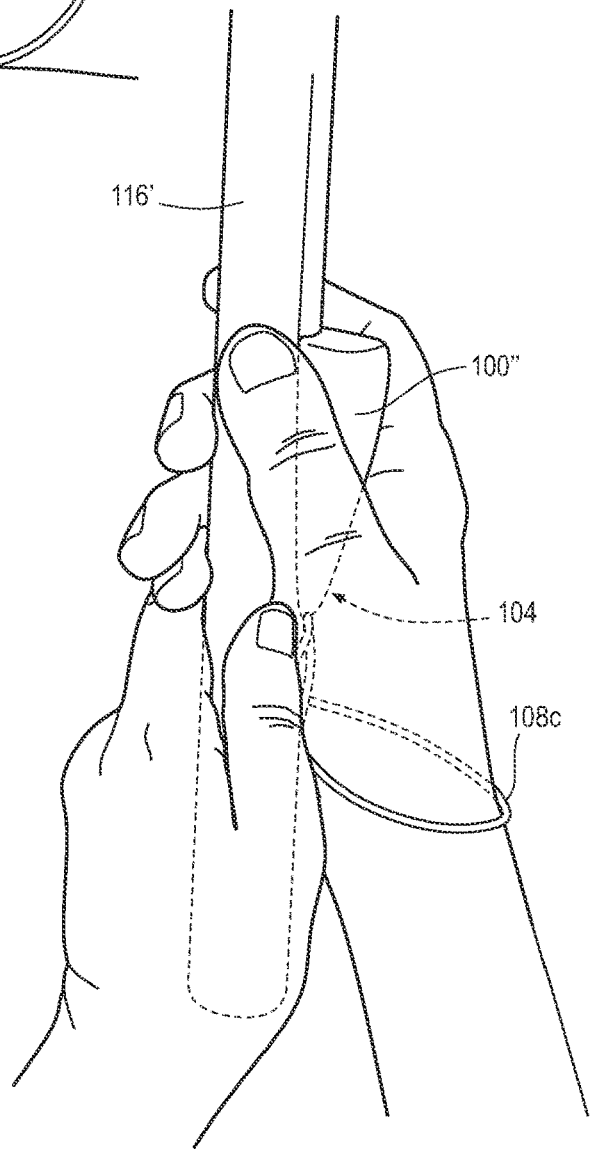
Figure 12D:
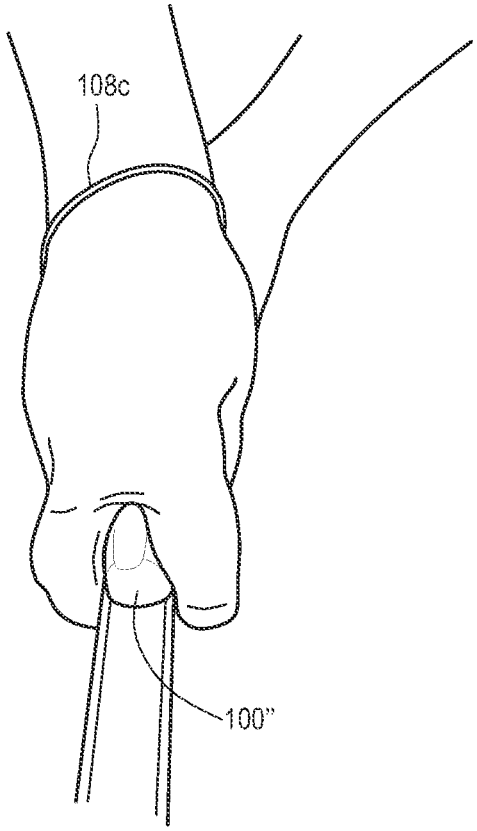
FIG. 12D illustrates a "split finger" type of golf grip, used with the wedge of the present invention.
Figure 12C:
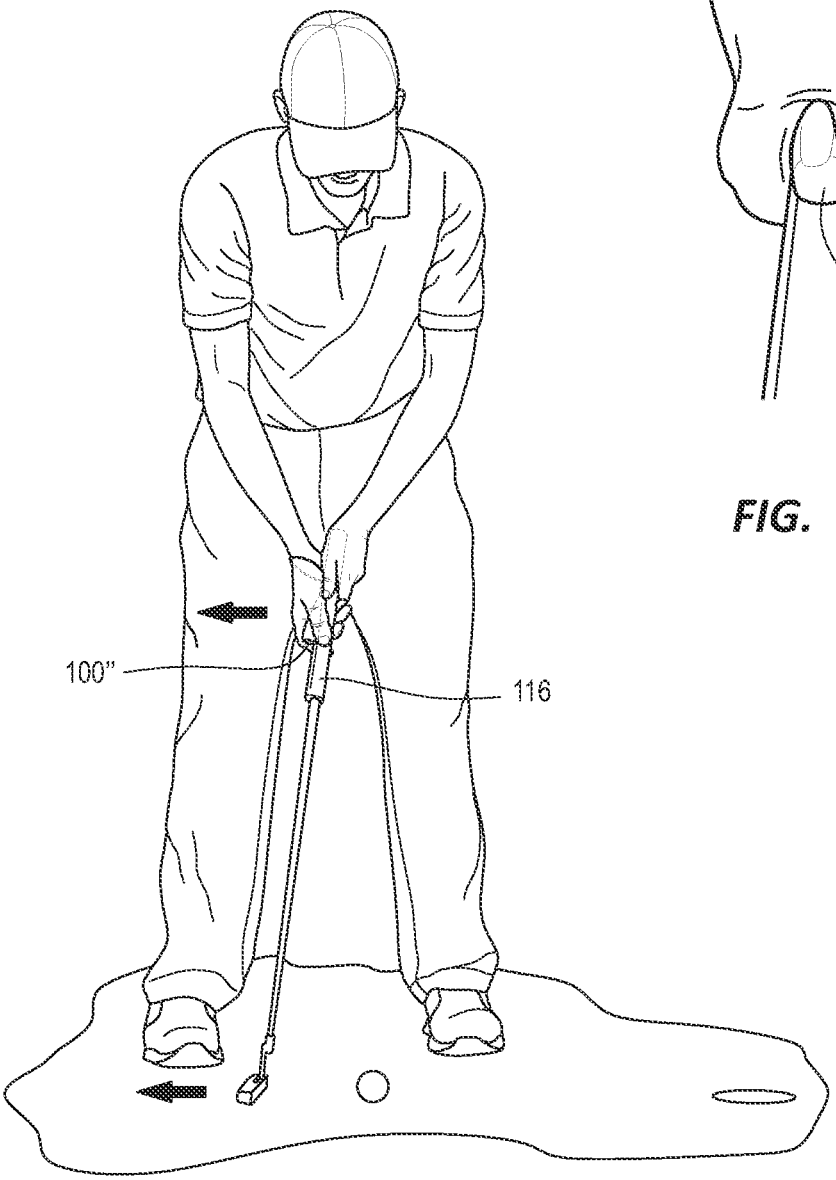

FIGS. 12A-12B and 12C show how the wedge (a wedge similar to wedge 100" is shown, but without the top loops) may be used to provide similar advantages when gripping a golf club 116'. The curvature provided along surface 106 may still be concave, but may differ somewhat from the circular curvature of a baseball bat handle, depending on the actual curvature of the golf club 116'. FIG. 12D illustrates how such a wedge 100" may be used with a "split finger" golf grip.

Whether used with a baseball bat or a golf club, the purpose of the power wedge is to create an area where the bat is held in the upper hand, creating a larger effective diameter for gripping, for a more firm and larger diameter grip with the hand and finger grip, giving more upper hand strength to the batter or hitter.

Squeezing a larger area (e.g., increased diameter) in the batter's hand gives more natural strength to the fingers and to the user's grip, creating greater bat or club control.

The distance the power wedge extends radially out from the bat or club gives the user a larger area to grip, so as to create faster or improved wrist coordination, faster bat or club speed, and greater power when hitting the ball. This results in hitting the ball harder and further and better puts the batter in sync with a batter's legs, hips, arms, wrists and hand timing as the batter hits the ball. Similar benefits are provided for a golfer.

In an embodiment, the face of the wedge that is opposite the convexly curved interior is also provided with a curvature, extending along the longitudinal length of the wedge that molds the wedge to the curvature of the palm of the batter's hand, while the interior "trough" curvature associated with surface 106 is molded to provide a substantially perfect fit to match the curvature of the handle of the baseball bat, or golf club. Such features provide for an overall better connection between the hand, glove, wedge and bat or club, for more powerful and successful hand eye coordination.

The terminology used herein is for the purpose of describing particular embodiments only and is not intended to be limiting of the invention. Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant work.

The articles "a," "an," and "the" are intended to mean that there are one or more of the elements in the preceding descriptions. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features. Numbers, percentages, ratios, or other values stated herein are intended to include that value, and also other values that are "about" or "approximately" the stated value, as would be appreciated by one of ordinary skill in the art encompassed by embodiments of the present disclosure. A stated value should therefore be interpreted broadly enough to encompass values that are at least close enough to the stated value to perform a desired function or achieve a desired result. The stated values include at least the variation to be expected in a suitable manufacturing or production process, and may include values that are within 10%, within 5%, within 1%, within 0.1%, or within 0.01% of a stated value. As used herein, the term "between" includes any referenced endpoints. For example, "between 2 and 10" includes both 2 and 10.

A user having ordinary skill in the art should realize in view of the present disclosure that equivalent constructions do not depart from the spirit and scope of the present disclosure, and that various changes, substitutions, and alterations may be made to embodiments disclosed herein without departing from the spirit and scope of the present disclosure. Equivalent constructions, including functional "means-plus-function" clauses are intended to cover the structures described herein as performing the recited function, including both structural equivalents that operate in the same manner, and equivalent structures that provide the same function. It is the express intention of the applicant not to invoke means-plus-function or other functional claiming for any claim except for those in which the words 'means for' appear together with an associated function. Each addition, deletion, and modification to the embodiments that falls within the meaning and scope of the claims is to be embraced by the claims.

The terms "approximately," "about," and "substantially" as used herein represent an amount close to the stated amount that still performs a desired function or achieves a desired result. For example, the terms "approximately," "about," and "substantially" may refer to an amount that is within 10% of, within 5% of, within 1% of, within 0.1% of, and within 0.01% of a stated amount. Further, it should be understood that any directions or reference frames in the preceding description are merely relative directions or movements. For example, any references to "up" and "down" or "above" or "below" are merely descriptive of the relative position or movement of the related elements, when in a given orientation.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

The invention claimed is:

1. A method for using a baseball or golf hitting glove including a power wedge, the method comprising:

providing a glove body for receiving a user's hand or portion thereof;

providing a power wedge; and positioning the power wedge between a thumb and index finger of the glove with a longitudinal axis of the power wedge oriented down a palm towards a wrist of the user, over the right portion of the palm in a right handed glove, or over the left portion of the palm in a left handed glove, where the wedge includes an elongate teardrop shape, and a tapering thickness.

2. The method of claim 1, wherein the glove is a baseball batting glove.

3. The method of claim 1, wherein the wedge is formed of an elastomeric material.

4. The method of claim 1, wherein the longitudinal axis of the wedge having the elongate teardrop shape is oriented generally parallel to the thumb.

5. The method of claim 1, wherein the glove body includes a pouch or pocket into which the wedge is received.

6. The method of claim 1, wherein the wedge increases swing speed of a batter as compared to a similar glove that does not include the wedge.

7. The method of claim 1, wherein the wedge is selectively removable from a pouch or pocket in the glove body.

8. The method of claim 1, wherein the glove is provided with a plurality of wedges of different sizes, allowing a user to select an appropriately sized wedge for use.

9. The method of claim 1, wherein the glove includes a pull tab wrist band where the pull tab is routed through a ring, so that the pull tab extends through the ring, for pulling back the opposite direction, for tightening the glove around the wrist of a user, better than a hook and loop material wrist band, that includes no ring, and does not pull back over itself in the opposite direction during tightening.

10. A method for using a power wedge with a baseball bat the method comprising:

providing a wedge having an elongate teardrop shape, the wedge including one or more elastomeric loops embedded into the elongate teardrop shape of the wedge, for securing the wedge in position by inserting into each of the one or more elastomeric loops a finger or thumb of a batter;

positioning the wedge between a thumb and index finger of a batters hand, over a right portion of the palm in a right handed batter, or over a left portion of the palm in a left handed batter; and securing the wedge in position by inserting a finger or thumb into each of the one or more elastomeric loops.

11. The method of claim 10, wherein the wedge is formed of an elastomeric material.

12. The method of claim 10, wherein a longitudinal axis of the wedge having the elongate teardrop shape is oriented down a palm towards a wrist of the batter with the longitudinal axis of the wedge oriented generally parallel to the thumb during use.

13. The method of claim 10, wherein the wedge increases swing speed of a batter as compared to swing speed without the wedge.

14. The method of claim 10, wherein the wedge is secured to the bat handle by hook and loop material or another fastening mechanism.

15. A method for using a power wedge with a baseball bat, the method comprising:

providing the wedge;

positioning the wedge between a thumb and index finger of a batters hand with a longitudinal axis of the wedge oriented down a palm towards a wrist of the batter, over a right portion of the palm in a right handed batter, or over a left portion of the palm in a left handed batter, where the wedge includes an elongate teardrop shape and including a top end, a tapered thin and narrow bottom end, and an interior face; and mating the wedge with a handle of the bat, wherein the interior face is convexly curved to correspond to a curvature of the handle of the bat, wherein the top end is wider and thicker in y and z directions, respectively, than the tapered thin and narrow bottom end.

16. The method of claim 15, wherein the wedge is formed of an elastomeric material.

17. The method of claim 15, further comprising one or more elastomeric loops embedded into the elongate teardrop shape of the wedge, wherein said one or more elastomeric loops extend from at least one of the top end or the narrow bottom end of the wedge.

18. The method of claim 17, wherein the one or more elastomeric loops extend from the top end of the wedge.

19. The method of claim 17, wherein the one or more elastomeric loops extend from the bottom end of the wedge.

20. The method of claim 17, wherein the one or more elastomeric loops include at least two elastomeric loops, where loops extend from both the top and bottom ends of the wedge.

21. The method of claim 10, wherein the one or more elastomeric loops include three elastomeric loops, where two loops extend from the top end of the wedge, and one loop extends from the bottom end of the wedge, the two loops of the top end of the wedge are wrapped around the index finger and thumb, while the loop at the bottom end of the wedge is wrapped around a wrist of the batter.

* * * * *